US007973227B2

(12) United States Patent
Paige

(10) Patent No.: US 7,973,227 B2
(45) Date of Patent: Jul. 5, 2011

(54) QUICK-FIX CAPO HAVING DUAL ADJUSTABILITY MODES FOR USE WITH A STRINGED MUSICAL INSTRUMENT, AND METHOD OF USING SAME

(76) Inventor: Bryan Paige, Jonesville, MI (US)

( * ) Notice: Subject to any disclaimer, the term of this patent is extended or adjusted under 35 U.S.C. 154(b) by 0 days.

(21) Appl. No.: 12/753,260

(22) Filed: Apr. 2, 2010

(65) Prior Publication Data

US 2010/0251873 A1 Oct. 7, 2010

Related U.S. Application Data

(60) Provisional application No. 61/166,389, filed on Apr. 3, 2009.

(51) Int. Cl.
*G10D 3/00* (2006.01)

(52) U.S. Cl. ..... 84/318

(58) Field of Classification Search ..... 84/315–318, 84/267, 290, 312 R
See application file for complete search history.

(56) References Cited

U.S. PATENT DOCUMENTS

| | | | | |
|---|---|---|---|---|
| 150,900 | A | 5/1874 | Silver et al. | |
| 608,278 | A | 8/1898 | Benson | |
| 656,904 | A | 8/1900 | Pletcher | |
| 775,399 | A | 11/1904 | Halladay | |
| 1,007,960 | A | 11/1911 | Moore | |
| 2,461,687 | A | 2/1949 | Hopfeld | |
| 2,463,263 | A | 3/1949 | Gordon | |
| 3,599,960 | A | 8/1971 | Phillips | |
| 4,104,947 | A | 8/1978 | Oster | |
| D257,988 | S | 1/1981 | Nakamoto | |
| 4,250,790 | A * | 2/1981 | Shubb et al. | 84/318 |
| D281,508 | S | 11/1985 | McKinney, III | |
| 5,081,894 | A | 1/1992 | Paige | |
| 6,250,621 | B1 | 6/2001 | Ping | |
| D446,540 | S | 8/2001 | Elliott | |
| 6,962,099 | B2 | 11/2005 | Slepekis | |
| 7,036,807 | B1 | 5/2006 | Gasparyan et al. | |

* cited by examiner

*Primary Examiner* — Kimberly R Lockett
(74) *Attorney, Agent, or Firm* — Carrier Blackman & Associates, P.C.; William D. Blackman; Joseph P. Carrier

(57) ABSTRACT

A capo is structured and configured to permit rapid installation and tightening thereof on a stringed instrument. The capo includes a yoke with a central support member, a string-contacting clamping bar which is pivotally attached to the yoke, and a spring-loaded release member which fits into a first hollow bore in the central support member of the yoke. The capo also includes a substantially Y-shaped saddle member having a stem which slidably fits through a second hollow bore of the central support member, and an adjustment member for positioning the saddle member in the yoke. The engagement/release member is releasably held in position against the adjustment member by spring pressure. Rapid positioning of the saddle member is enabled by both coarse and fine adjustment of the adjustment member, made possible by buttressed threads present both inside of the engagement/release member and outside of a threaded shaft of the adjustment member.

7 Claims, 16 Drawing Sheets

QUICK-FIX CAPO HAVING DUAL ADJUSTABILITY MODES FOR USE WITH A STRINGED MUSICAL INSTRUMENT, AND METHOD OF USING SAME

BACKGROUND OF THE INVENTION

1. Field of the Invention

The present invention relates to a capo, for use with a stringed musical instrument to effectively change the key in which the instrument is playing, and to a method of using the capo. More particularly, the present invention relates to a capo having dual adjustability modes including a quick-fix feature, and to a related method, whereby a coarse tightening adjustment can rapidly be made immediately during installation, followed by a fine tightening adjustment effected by rotating a thumbscrew.

2. Description of the Background Art

A number of different capos are known for use with stringed musical instruments, particularly guitars, banjos and the like, which have a neck portion including a fretboard on which the strings are played. The capo is a clamping device which fits on the instrument neck, and which is used to selectively clamp the strings against the fretboard so as to alter the effective length of vibration of the strings, and thereby to selectively raise the respective tones produced thereby.

The capo allows for selective alteration of the tonality of the strings without affecting the original tuning of the instrument. Thus, by placing the capo at a pre-selected location on the fretboard, a musician can play his/her instrument and produce a desired sound quality, since the pitch produced by the strings with the capo attached is different from the pitch produced by the stings with the capo absent. This allows a musician to temporarily change the effective key in which the instrument is playing.

A number of different capos are known and commercially available. Each of these is basically a clamping device in which a padded clamping bar is caused to press transversely across the strings by operation of an adjustable clamping mechanism that interacts with the underside of the neck below the fretboard.

U.S. Pat. No. 608,278 to Benson, dated Aug. 2, 1898, discloses a capo having a generally U-shaped main body, a clamping bar connected to the upper portion of the main body for transversely contacting the fretboard strings, a foot for pressing against the underside of the fretboard, a screw operated clamping mechanism and a guide finger interconnected with the foot and the lower portion of the main body for keeping the foot from turning when the screw of the screw operated clamping mechanism is rotated to effect clamping of the clamping bar onto the strings.

U.S. Pat. No. 656,904 to Pletcher, dated Aug. 28, 1900, discloses a capo having a clamping bar for pressing transversely against the strings, a clasp member pivotally connected to the clamping bar, an arm member connected to one end of the clamping bar, and a spring steel clip pivotally connected with the arm and which is structured to selectively engage the clasp member.

U.S. Pat. No. 775,399 to Halladay, dated Nov. 22, 1904, discloses a capo having a clamping bar for transversely engaging the strings, an arm connected to the clamping bar, and a screw actuated lever clamp pivotally interconnected with the arm.

U.S. Pat. No. 1,007,960 to Moore, dated Nov. 7, 1911, discloses a capo having a clamping bar for transversely contacting the strings, a rod pivotally connected at either side of the clamping bar, and a screw operated foot pivotally connected to the free ends of the rods.

U.S. Pat. No. 4,104,947 to Oster, dated Aug. 8, 1978, discloses a capo having a U-shaped member of which the upper portion thereof serves as a clamping bar for transversely engaging the strings, two off-set resilient string engaging members, a screw operated clamping mechanism connected with the lower portion of the U-shaped member and a foot interconnected with the clamping mechanism and a central portion of the U-shaped member.

U.S. Pat. No. 4,250,790 to Shubb et al, dated Feb. 17, 1981, discloses a capo having a clamping bar with a resilient material for transversely contacting the strings, an arm connected to the clamping bar, a curved jaw pivotally connected to the arm for contacting the underside of the fretboard, a lever pivotally connected to the arm in spaced relation with respect to the curved jaw, and a screw mechanism interconnected with the lever.

U.S. Design Pat. No. D257,988 to Nakamoto, dated Jan. 20, 1981, discloses an ornamental design for a capo showing a yoke having a pivotally connected clamping bar for transversely contacting the strings, a releasable clasp mechanism for holding the clamping bar in fixed relation to the yoke, and a screw operated clamp mechanism which includes a foot for contacting the underside of the fretboard and guide rods for preventing the foot from rotating when the screw is rotated.

U.S. Design Pat. No. D281,508 to McKinney, III, dated Nov. 26, 1988, discloses an ornamental design for a capo showing a yoke having a pivotally connected clamping bar for transversely contacting the strings, a releasable clasp mechanism for holding the clamping bar in fixed relation to the yoke, and a screw operated clamp mechanism which includes a foot for contacting the underside of the fretboard and a guide member for preventing the foot from rotating when the screw is rotated.

U.S. Design Pat. D446,540 issued Aug. 14, 2001 to Elliott discloses another ornamental capo design.

U.S. Pat. No. 5,081,894 to Paige, issued Jan. 21, 1992, discloses a capo including a semi-circular yoke, a clamping bar pivotally connected to a first fork of the yoke and releasably interlocked at the second end to a second fork of the yoke via intermeshing of opposing slots, a clasp mechanism for releasably locking onto an end of the clamping bar, a screw-operated foot connected with the yoke, and dual guide clamping bars connected at either side of the foot which movably engage slots in the yoke. The capo of this reference engages the strings uniformly and simultaneously as the screw is tightened.

In addition to the above, some hand tools are known which use fast-acting dual phase engagement structure. Some examples of fast-acting clamps and other tools can be found in Silver et al., U.S. Pat. No. 150,900; Gordon, U.S. Pat. No. 2,463,263; Hopfeld, U.S. Pat. No. 2,461,687; Phillips, U.S. Pat. No. 3,599,960; Ping, U.S. Pat. No. 6,250,621; Slepekis, U.S. Pat. No. 6,962,099; and Gasparyan et al., U.S. Pat. No. 7,036,807.

While the foregoing examples of capos and other tools are usable for their intended purposes, a need still exists in the art for an improved capo. In particular, there is a need for an improved capo, and method of installing same, which is capable of being installed and adjusted quickly, and which includes both coarse and fine tightening modes.

SUMMARY OF THE INVENTION

Accordingly, it is an object of the present invention to provide an improved capo, which is capable of being installed and adjusted quickly, and which includes both coarse and fine tightening modes.

This type of capo is particularly useful in a performance environment, such as in professional stage and concert performances, as speed of adjusting the effective key between musical numbers is important. The present invention also provides a method of using the inventive capo.

The capo is provided for use with a stringed musical instrument having a neck portion including a fretboard, and a plurality of strings extending parallel to one another above the fretboard.

A capo according to a first illustrative example of the invention includes a yoke having a central support member, a padded string-contacting clamping bar which is pivotally attached to the yoke, and a spring-loaded engagement/release member which fits into a first hollow bore in the central support member of the yoke.

The capo also includes a substantially Y-shaped saddle member, including a stem which slidably fits through a second hollow bore of the central support member, a seat portion which is configured to contact a neck of an instrument, and an adjustment member for positioning the saddle member in the yoke. The engagement/release member is releasably held, by spring pressure, in position against the adjustment member.

Rapid positioning of the saddle member is enabled by either coarse or fine adjustment of the adjustment member, made possible by buttressed threads present both inside of the engagement/release member and outside of a threaded shaft of the adjustment member.

The yoke is substantially U-shaped, and includes a central support member, with a first hollow bore formed therein defining a first axis, and having a back wall therein at the innermost portion of the first hollow bore. The central support member also has a second hollow bore formed therethrough, defining a second axis which is substantially perpendicular to the first axis, where the second hollow bore intersects the first hollow bore.

The yoke according to the first illustrative embodiment also includes a first yoke branch extending outwardly on one side of the central support member, and a second yoke branch extending outwardly on the other side of the central support member. The first yoke branch has a first yoke branch end having a bent portion with a first opening formed therein to receive a pivot member.

The capo according to the illustrative embodiment also includes a spring disposed in the first hollow bore of the yoke, adjacent the yoke back wall.

The capo according to the illustrative embodiment also includes an engagement/release member configured to fit slidably in the first hollow bore of the yoke, the engagement/release member having a hollow opening formed therethrough, formed in a substantially oval cross-sectional shape, with buttressed female threads formed therein on one side of the hollow opening. The stem of the saddle member fits through the hollow opening of the engagement/release member.

The opening in the engagement/release member is aligned with the second hollow bore of the yoke. The engagement/release member has an inner end with a spring-contacting surface for contacting the spring, and an outer end extending outwardly from the yoke, where the outer end provides an engaging surface provided for being contacted by a user to press the engagement/release member inwardly against the spring.

The capo according to the first illustrative embodiment also includes a clamping bar having a first end which is pivotally connected with the bent portion of the first yoke branch end via the pivot member. The clamping bar also has a second end which is operatively engagable with the opening of the second yoke branch, for temporarily and releasably locking the clamping bar on to the second yoke branch end.

The capo according to the first illustrative embodiment also includes a substantially Y-shaped saddle member, including a central stem and a seat portion integrally attached to an end of the stem. The seat portion is provided for placement contacting a portion of the musical instrument's neck opposite the fretboard. The central stem of the saddle member has a substantially crescent-shaped cross-section and has a hollow channel formed therein. The seat portion of the saddle member has a recessed cavity formed therein adjacent a juncture of the stem portion and the seat portion.

The capo according to the first illustrative embodiment also includes an adjustment member including a graspable handle portion and a shaft portion which fits into the concave groove of the saddle member. The shaft portion of the adjustment member has a tip end which fits into the recessed cavity of the saddle member, and also has male buttressed threads formed on an outer surface thereof for selective engagement with the buttressed threads of the engagement/release member.

In use, the adjustment member can be pressed inwardly towards the musical instrument, to slidably move the buttressed threads thereof past the buttressed threads of the engagement/release member in order to make a coarse tightening adjustment. When the coarse tightening adjustment has been completed, the handle portion of the adjustment member can then be selectively rotated to make a fine tightening adjustment.

Additional embodiments of the present invention are also contemplated, and are described herein in the detailed description section.

For a more complete understanding of the present invention, the reader is referred to the following Detailed Description section, which should be read in conjunction with the accompanying drawings. Throughout the following detailed description and in the drawings, like numbers refer to like parts.

DETAILED DESCRIPTION OF ILLUSTRATIVE EMBODIMENTS

Figure 1:
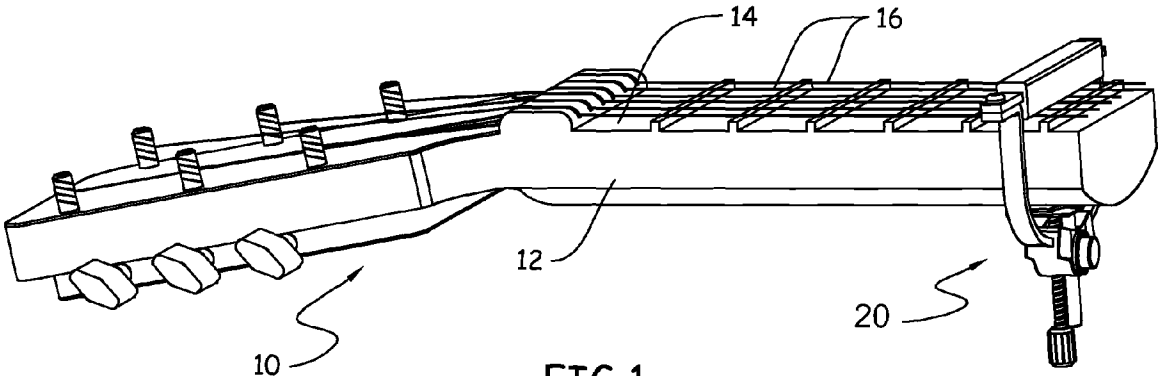
FIG. 1 is an environmental perspective view, partially cut away, of a guitar neck having a capo installed thereon according to a first illustrative embodiment of the present invention.

Descriptions will be provided below of selected illustrative embodiments of the present invention on a basis of examples of the present invention, supported by and shown in the accompanying drawings. It should be understood that only structures considered necessary for clarifying the present invention are described herein. Other conventional structures, and those of ancillary and auxiliary components of the system, will be known and understood by those skilled in the art.

Throughout the present specification, relative positional terms like 'upper', 'lower', 'front', 'rear', 'top', 'bottom', 'horizontal', 'vertical', and the like are used to refer to the orientation of the capo apparatus as shown in the drawings. These terms are used in an illustrative sense to describe the depicted embodiments, and are not meant to be limitative. It will be understood that the depicted apparatus may be placed at an orientation different from that shown in the drawings, such as inverted 180 degrees or transverse to that shown, and in such a case, the above-identified relative positional terms will no longer be accurate.

While the drawings and description herein describe the capo as used with a stringed instrument such as a guitar, it should be understood that the stringed instrument does not form part of the invention, but rather, is used as a workpiece on which the capo hereof is applied.

Capo Structural Overview

Figure 2:
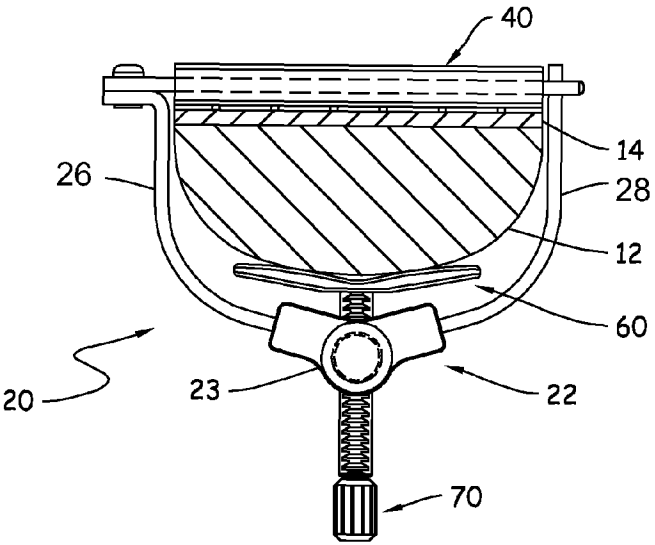
FIG. 2 is a front plan view of the capo of FIG. 1, showing a portion of the guitar neck in cross-section.
Figure 3:
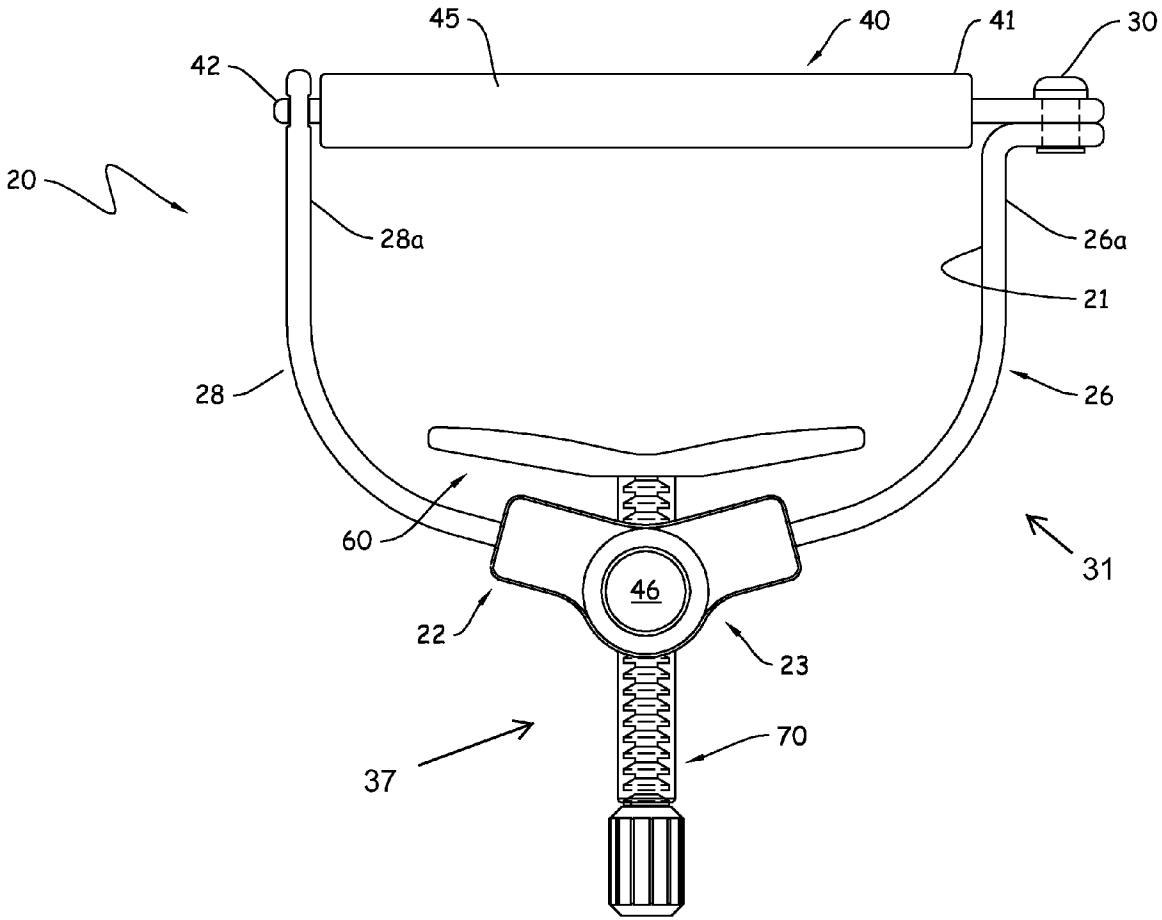
FIG. 3 is a front plan view of the capo of FIGS. 1-2, shown separately from a guitar.
Figure 4B:
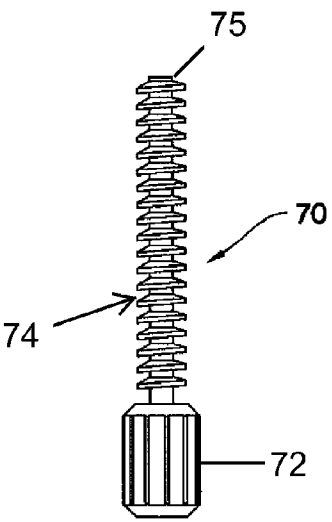
FIG. 4B is a side plan view of an adjustment member which is a component of the capo of FIG. 3.
Figure 4A:
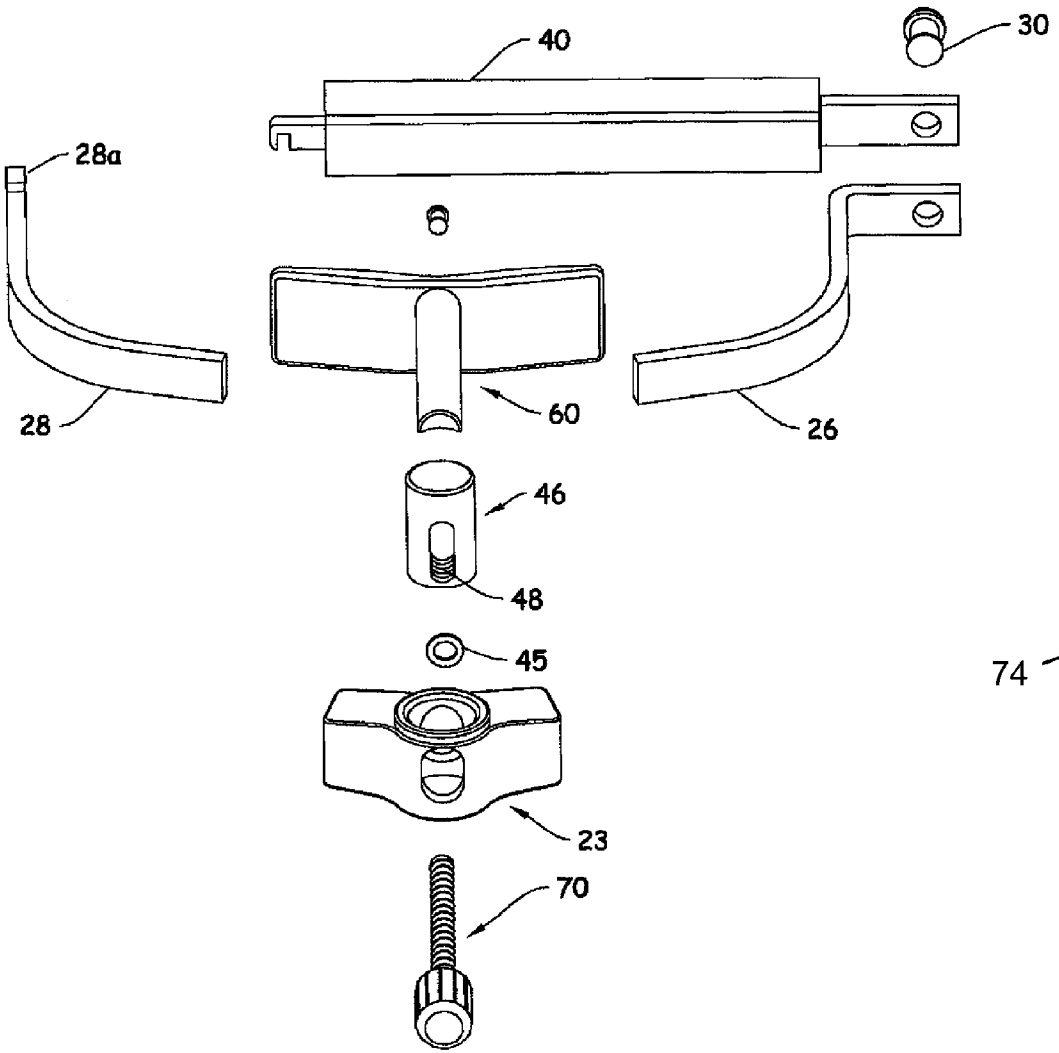
FIG. 4A is an exploded perspective view of the capo of FIG. 3.

Referring now to the drawings, FIGS. 1-3 generally show a capo 20 according to a first illustrative embodiment of the present invention, in operation on a fretboard 14 situated on one side of a neck 12 of a stringed instrument 10.

The capo 20 includes two main parts, a yoke assembly 31 and a slide assembly 37 which is slidably movable relative to the yoke assembly.

The Yoke Assembly

The yoke assembly 31 includes a substantially U-shaped yoke 22, as shown, including a central support member 23, as well as first and second yoke branch portions 26, 28 respectively attached to opposite sides of the central support member 23. The yoke assembly 31 also includes a pivotally movable and padded clamping bar 40, which is pivotally connected to one yoke branch portion 28 of the yoke 22.

The yoke assembly 31 further includes a spring-loaded engagement/release member 46 disposed in a central bore of the central support member 23. The engagement/release member 46 is provided for selectively engaging or releasing the adjustment member, to allow for either coarse or fine adjustment of the position of the adjustment member and the attached saddle member 60 during use. The yoke 22, engagement/release member 46 and clamping bar 40 cooperate to define a yoke assembly 31, which generally stays together as a connected unit.

The Slide Assembly

The capo 20 also includes a slide assembly 37 including a saddle member 60, which slidably fits through a bore formed in the central support member of the yoke 22, and an adjustment member 70 which is rotatably attached to the saddle member in a manner so as to allow free rotation of the adjustment member relative to the saddle member.

The adjustment member 70 is also adjustably connected to the central support member 23 of the yoke 22, as will be further described herein. The saddle member 60 and the adjustment member cooperate to define the slide assembly 37, which generally stays together as a connected unit, and which is adjustably movable relative to the yoke assembly, to allow for tightening of the capo in place on an instrument neck 12.

As can be seen from reference to FIGS. 1 and 2, when the capo 20 is installed on an instrument 10, the clamping bar 40 is structured to extend transversely across the strings 16 of the fretboard 14. By applying a clamping force onto the strings 16, the strings are forced against the fretboard, thereby effectively changing the vibration length of the strings.

The compressive force of the clamping bar 40, pressing onto the strings 16, is reinforced by a seat portion of the saddle member 60 being squeezed against the back of the neck portion 12 of the instrument. The position of this saddle member is adjusted through operation of the adjustment member 70, which is adjusted to cause the linked saddle member 60 to slide with respect to the yoke 22, until the clamping bar 40 applies a desired compressive force upon the strings.

Further details of each of the structural components of the capo 20 will now be described.

In FIG. 3 of the drawings, the capo 20 according to the first embodiment of the present invention is shown separately from the instrument 10. As previously noted, the yoke assembly 31 of the capo 20 includes the yoke 22, the clamping bar 40 and the spring-loaded engagement/release member 46. The generally U-shaped yoke 22 includes the central support member 23 and the yoke branch portions 26, 28. The clamping bar 40 is pivotally attached to one yoke branch portion 26 by the pivot member 30. The spring-loaded release member 46 is slidably disposed in a first hollow bore 25 formed in the central support member 23 of the yoke.

Figure 5A:
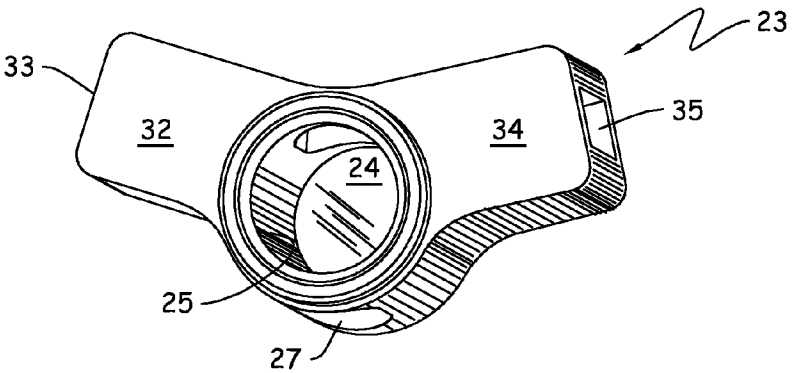
FIG. 5A is a first perspective view of a support member which is another component of the capo of FIG. 3, showing the back wall of the central support member.
Figure 5B:
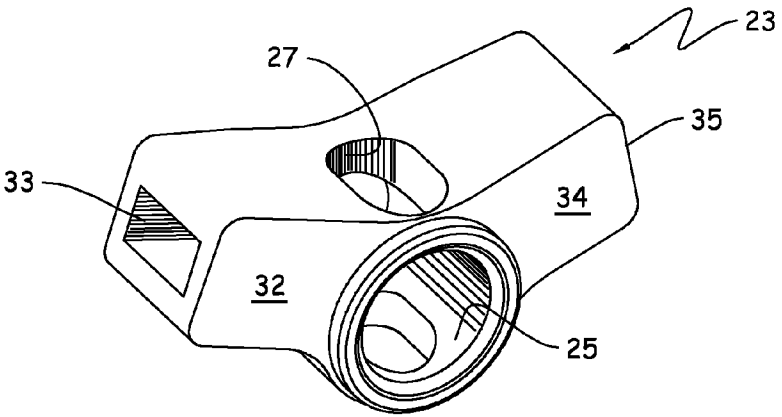
FIG. 5B is a second perspective view of the central support member of FIG. 5A, showing the oval outline shape of a second hollow bore therein.
Figure 6:
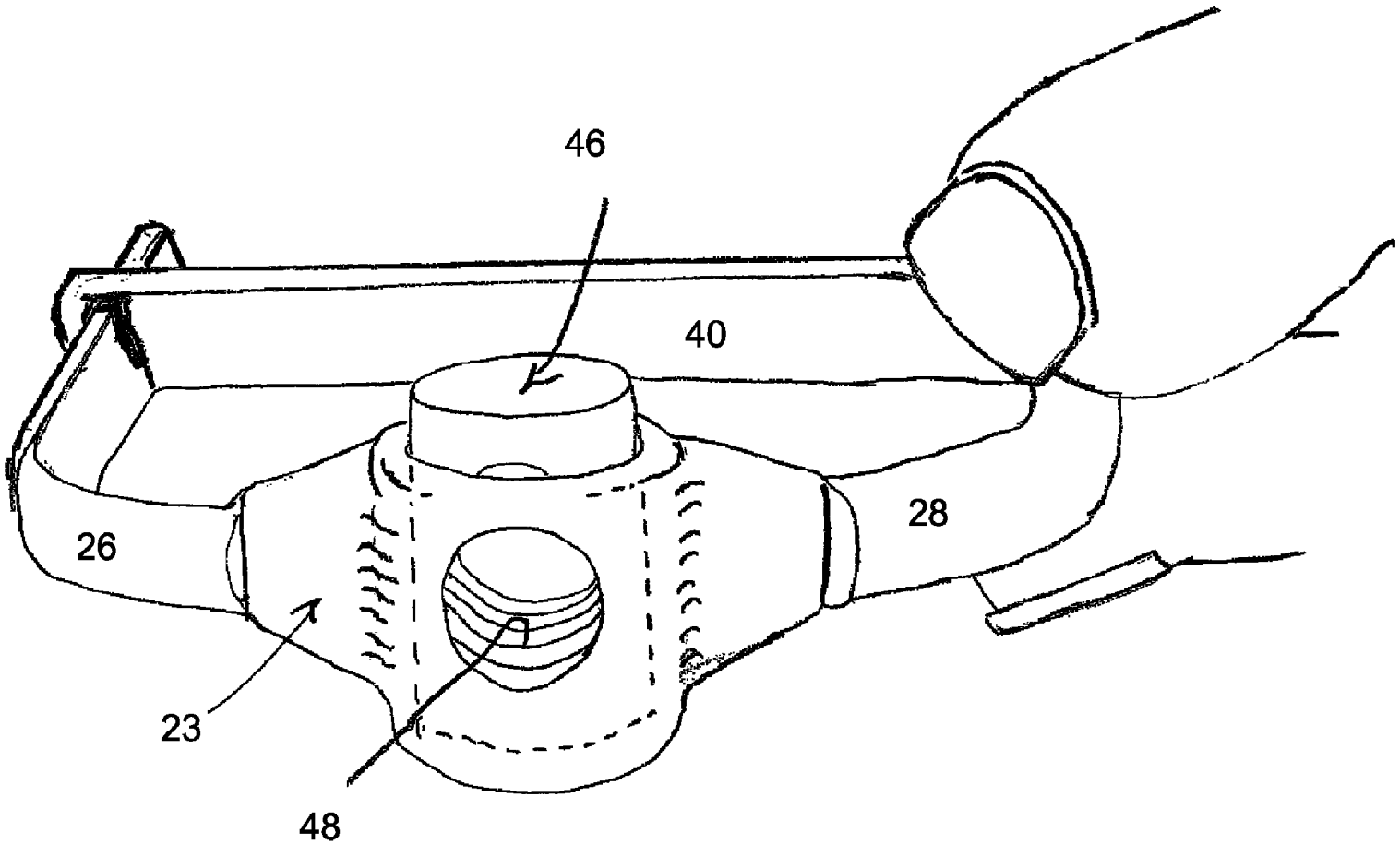
FIG. 6 is a lower perspective view of the capo of FIG. 3, with selected components omitted from the drawing for illustrative purposes.

As shown in FIGS. 5A-5B, the central support member has a back wall 24 therein at the innermost portion of the first hollow bore 25, and has a second hollow bore 27 formed therethrough and having an axis which is substantially perpendicular to an axis of the first hollow bore 25. The central support member 23 also has first and second support arms 32, 34 extending outwardly on substantially opposite sides thereof, and each of these support arms has a respective opening 33, 35 formed therein for receiving respective lower ends of the yoke branch portions 26, 28 therein.

The yoke 22 may be constructed of stainless steel, and is shaped and sized to generally fit about the neck portion of a standard stringed musical instrument 10 such a guitar, as shown in FIGS. 1-2. The yoke 22 is formed in an arcuate curvilinear U-shape, which is modified to have locally linear segments at the central support member 23 and adjacent each of the respective outer end portions 26*a* and 28*a* of the yoke branch portions 26 and 28, respectively.

The central support member 23 of the yoke has the engagement/release member 46 slidably disposed therein, with a hollow threaded opening 47 (FIG. 10C) formed substantially centrally in the engagement release member, through which a threaded shaft 74 of the adjustment member 70 passes, as will be further described herein.

The yoke 22 according to the first illustrative embodiment also includes a first yoke branch 26 extending outwardly on one side of the central support member 23, and a second (free) yoke branch 28 extending outwardly on the other side of the central support member. The first yoke branch 26 includes a first yoke branch end 26*a* having a bent portion with a first opening formed therein to receive a pivot member 30, so that the first yoke branch may be pivotally connected to the clamping bar 40. The pivot member 30 may be a rivet.

The capo 20 according to the first illustrative embodiment also includes the clamping bar 40 having a first end 41 which is pivotally connected with the bent portion of the first yoke branch end 26*a* via the pivot member 30. The clamping bar 40 also has a second end 42 which is operatively engagable with a notch 29 formed in the second yoke branch 28, for temporarily and releasably locking the movable notched end of the clamping bar 40 in place on the yoke 22. The clamping bar is pivotally 40 movable between an engaged position, shown in FIG. 3 of the drawings, and a disengaged position with the clamping bar rotated on the pivot member so that the first end 41 thereof extends away from the second arm portion 28, and the opening 21 of the yoke is uncovered to permit placement of the guitar on an instrument neck.

The clamping bar 40 may be constructed of stainless steel, and may have a generally rectangular cross-section. The clamping bar 40 is sufficiently long to span the distance between the yoke branches 26 and 28. It is generally preferred to cover all but the ends of the clamping bar 40 with a sleeve 45, which is intended to resiliently engage the strings 16. The sleeve 45 may be formed from a resilient polyurethane, from a material containing natural or synthetic rubber, or from another flexibly resilient polymeric material.

Figure 7A:
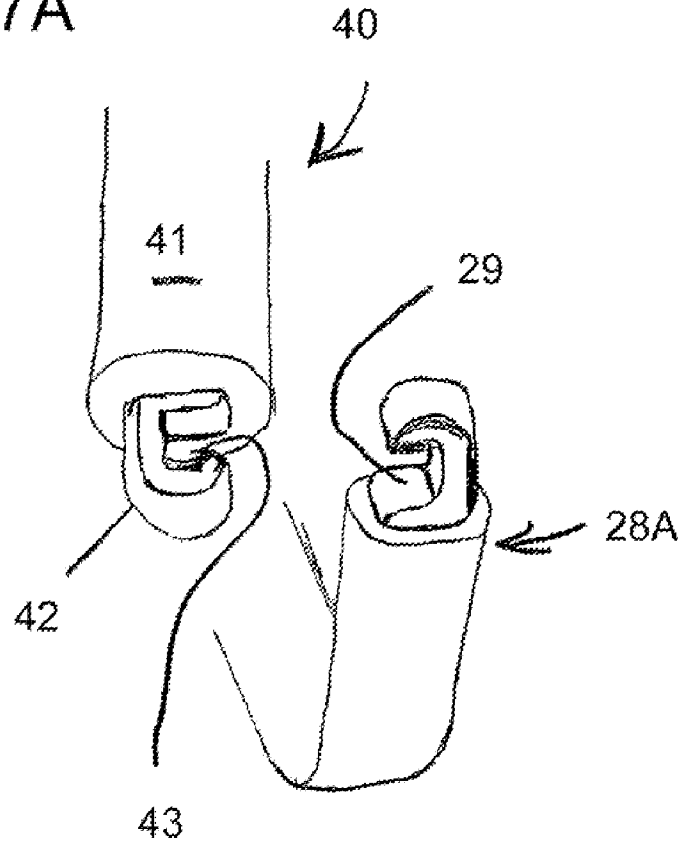
FIG. 7A is a detail perspective view showing engagement of a clamping bar portion of the capo with a yoke branch end.
Figure 7B:
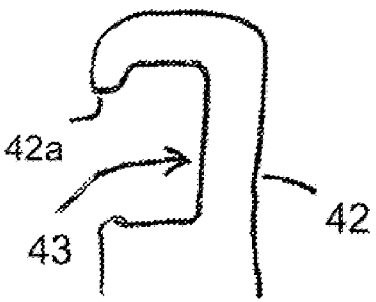
FIG. 7B is a detail plan view showing the configuration of the engaging structure of the clamping bar portion.

Referring now to FIGS. 7A-7B, the free branch end 28*a* of the yoke branch 28 is provided with a notch 29 formed therein, into which a first end 42 of the clamping bar 40 may be inserted.

The notch 29 of the free branch end 28*a* defines a first aperture, and a corresponding notch (second aperture) 43 is provided in a first end of the clamping bar 40.

FIG. 7B illustrates that the engagement end 42 of the clamping bar 40 may, optionally, have an inwardly extending hook 42*a* formed thereon adjacent the notch 43, in order to temporarily lock the end 42 of the bar in engagement with the yoke branch end 28*a*, when the capo is engaged on an instrument, an outward spring force is applied to the ends 26, 28 of the yoke, and a corresponding upward force is applied to the clamping bar 40.

The other end of the clamping bar 40 has a hole 36 formed therethrough to receive the pivot member 30. A corresponding hole 38 is formed through a bent portion at an upper end 26*a* of the first yoke branch portion 26, and the pivot member 30 is inserted into the respective holes 36, 38 to pivotally attach the clamping bar 40 to the yoke 22. As previously noted, the pivot member 30 may be a rivet, creating a relatively permanent pivot connection between the yoke 22 and the clamping bar 40.

Figure 9B:
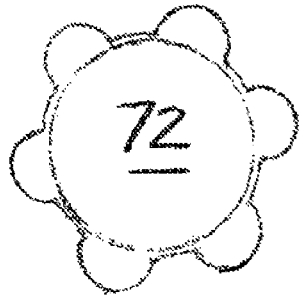
FIG. 9B is an end plan view of the adjustment member of FIG. 4B.
Figure 9A:
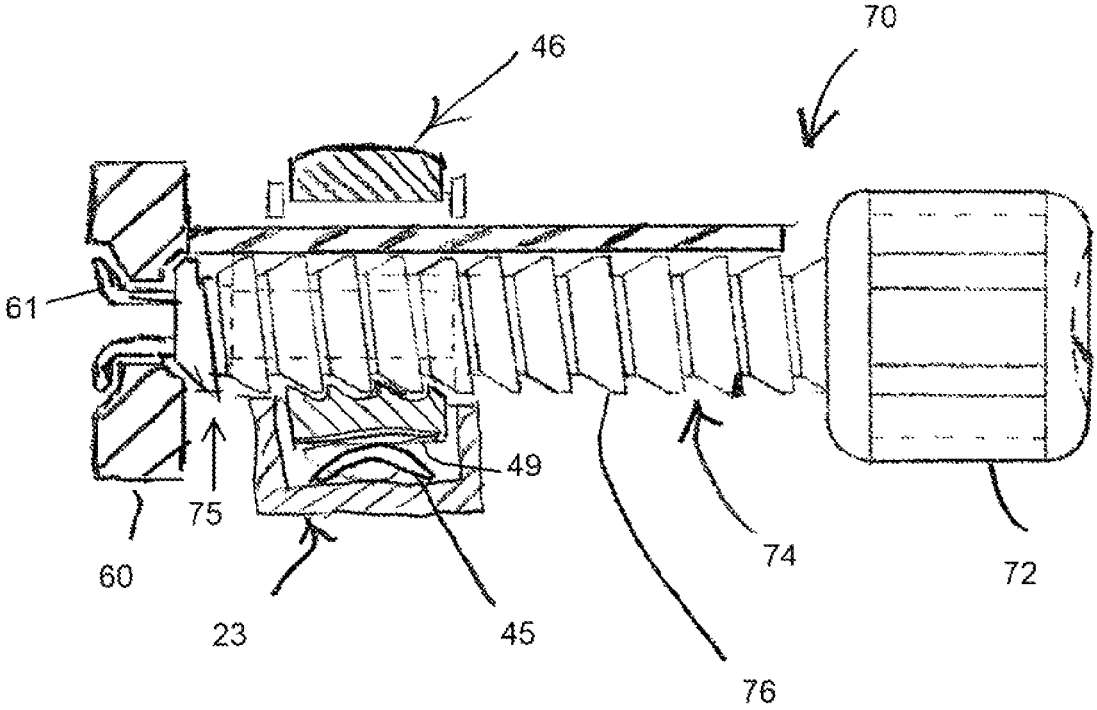
FIG. 9A is a cross-sectional view through the capo of FIG. 3.

The capo according to the first illustrative embodiment also includes a spring 45, disposed in the first hollow bore 25 of the yoke adjacent the yoke back wall 24. This spring 45 may be a spring washer, a leaf spring, or a coil spring. The spring 45 is situated between the yoke back wall 24 and an inner surface of the engagement/release member 46, and acts to press the engagement/release member outwardly in the first hollow bore 25. This pressure of the spring 45 tends to engage the buttressed female threads 48 of the engagement/release member into engagement with the buttressed male threads 76 of the adjustment member 70, as shown in FIG. 9A.

Figure 10C:
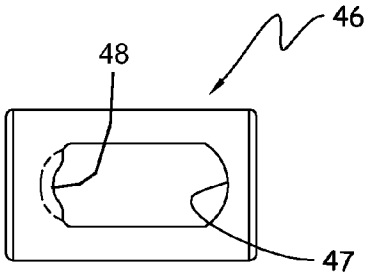
FIG. 10C is a top plan view of the engagement/release member of FIG. 10A.
Figure 10D:
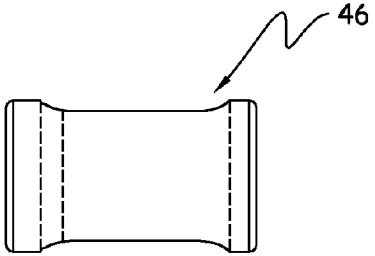
FIG. 10D is a side plan view of the engagement/release member of FIG. 10A.

The capo according to the first illustrative embodiment also includes the engagement/release member 46 configured to fit slidably in the first hollow bore 25 of the yoke's central support member 23. The engagement/release member 46 has a hollow opening 47 formed therethrough, formed with a substantially oval outline shape as seen in FIG. 10C, with buttressed female threads 48 formed therein on at least one side of the hollow opening, and a smooth wall (optionally) formed on another side of the hollow opening opposite the female threads. The stem 62 of a saddle member 60 fits through the hollow opening 47 of the engagement/release member.

The opening 47 in the engagement/release member 46 is aligned with the second hollow bore 27 of the yoke. The engagement/release member 46 has an inner end with a spring-contacting surface 49 for contacting the spring 45, and an outer end extending outwardly from the yoke, where the outer end provides an engaging surface for being contacted by a user, to press the engagement/release member 46 inwardly against the spring 45.

Figure 10A:
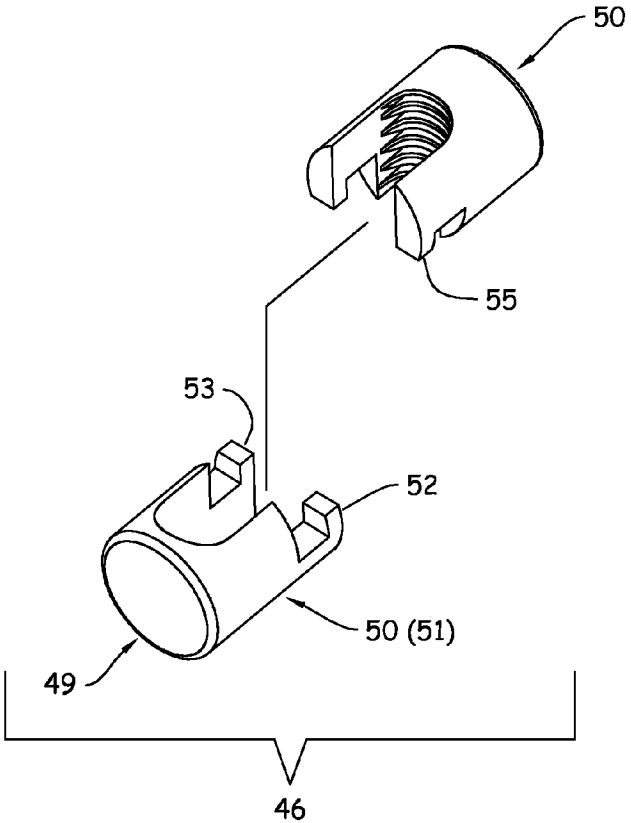
FIG. 10A is an exploded perspective view of an engagement/release member, which is another component of the capo of FIG. 3.
Figure 10B:
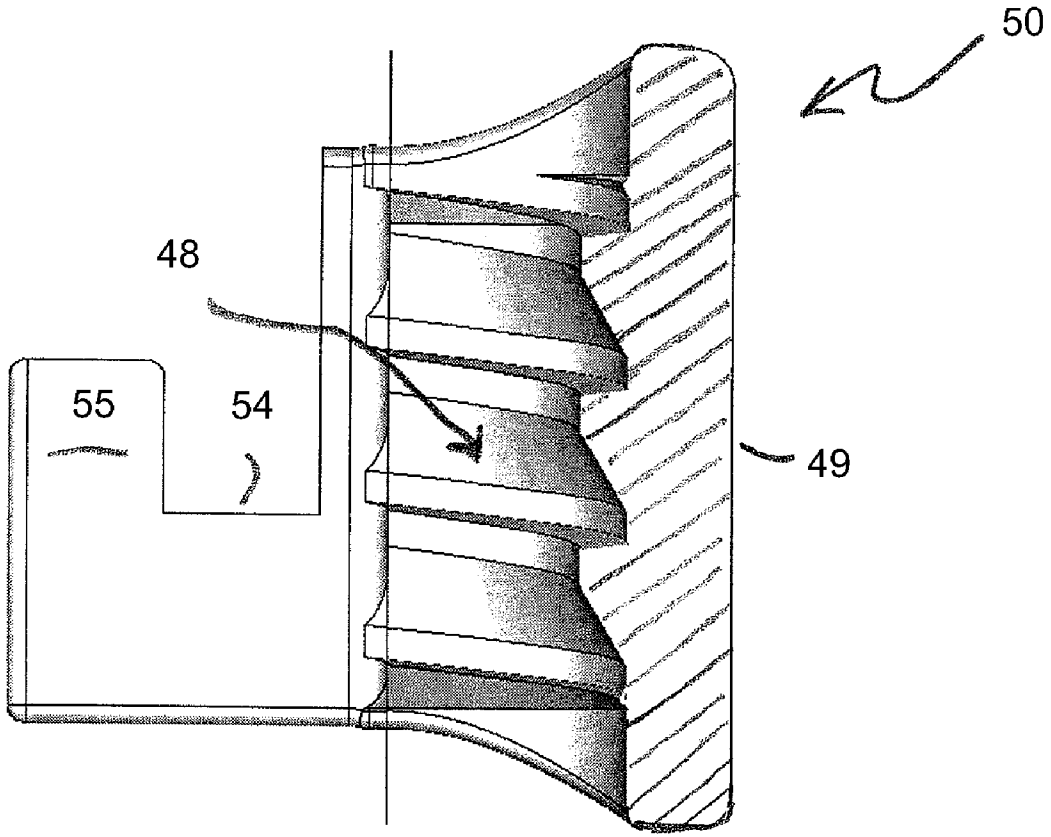
FIG. 10B is a cross-sectional view of one portion of the engagement/release member of FIG. 10A.
Figure 11A:
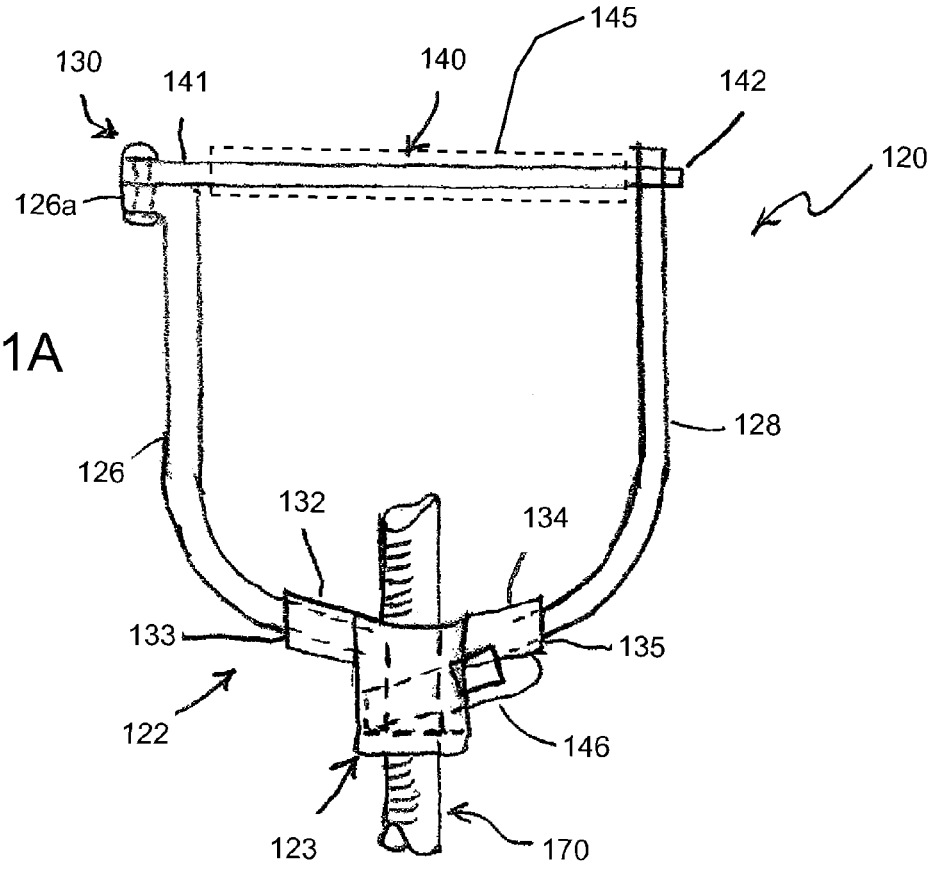
FIG. 11A is a rear plan view of a capo according to a second illustrative embodiment of the present invention.
Figure 11B:
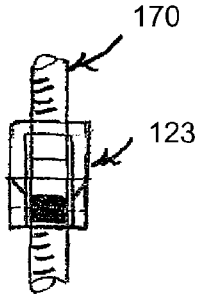
FIG. 11B is a side detail view showing an engagement portion of the capo of FIG. 11A.
Figure 11C:
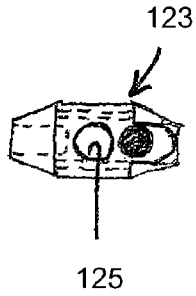
FIG. 11C is a bottom plan detail view of a support member, which is one component of the capo of FIG. 11A.
Figure 12:
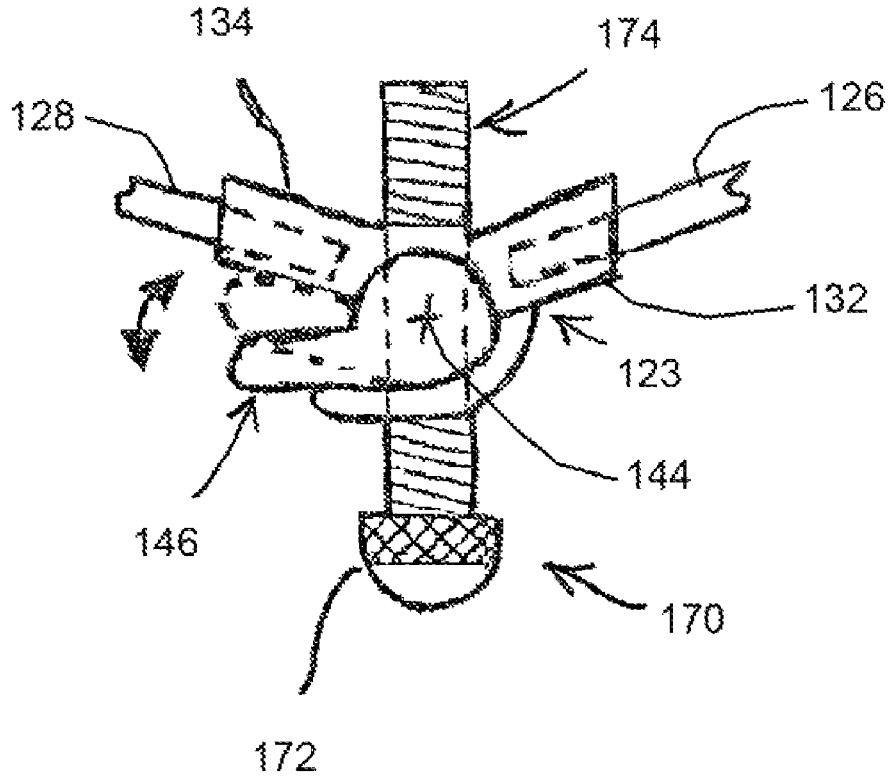
FIG. 12 is a front plan detail view showing of the engagement portion of the capo of FIG. 11A.

As shown in FIG. 10A, the engagement/release member may be made from two substantially identical section halves 50 assembled together to form a substantially cylindrical assembly. Each of the section halves 50 has a pair of spaced-apart outwardly extending projections 52, 53 thereon, and each of the respective projections 52, 53 has both a rectangular notch 54 formed therein and a tab 55 provided forward of, and parallel to the notch 54. The tabs 55 are slightly smaller than the notches 54, so as to fit snugly therein. The two section halves 50, 51 may be assembled by inserting the tabs 55 of a first section half 50 into the notches 54 of a second section half 51 (FIG. 10A), and pushing the two section halves 50, 51 together.

The Slide Assembly

As noted above, the saddle member 60 and the adjustment member cooperate to define a slide assembly 37. The substantially Y-shaped saddle member 60 slidably fits through the second hollow bore 27 of the central support member 23, and the adjustment member rests against a central stem of the saddle member, and also fits through the second hollow bore 27 of the central support member. The adjustment member 70 is used to selectively position the saddle member 60 in relation to the yoke 22.

The saddle member 60 (shown separately in FIGS. 8A-8C) includes a central stem 62 and a seat portion 64 integrally attached to an upper end of the stem. The seat portion 64 is provided for placement contacting a rear portion of the musical instrument's neck 12, opposite the fretboard 14. The central stem 62 of the saddle member has a substantially crescent-shaped cross-section. The central stem also has a hollow channel or concave groove 63 formed therein, to nestingly receive a threaded shaft 71 of the adjustment member 70. The seat portion 64 of the saddle member 60 has a recessed cavity 65 formed therein adjacent a juncture of the stem 62 and the seat portion 64, to accommodate a fastener 61 which pivotally connects the adjustment member 70 to the saddle member. The recessed cavity 65 may include an enlarged-diameter sunken seat portion 66 on the instrument-contacting side of the seat portion 64, to accommodate a flared outer end of the fastener 61 at a level below the instrument-contacting surface.

Rapid positioning of the saddle member 60 is made possible by both coarse and fine adjustment of the adjustment member 70 engaged with the yoke assembly, as will be described in further detail herein.

Referring again to FIG. 9A, the capo according to the first illustrative embodiment also includes the adjustment member 70, including a graspable thumbscrew or handle portion 72, and a shaft 74 which fits into the concave groove 63 of the saddle member 60. The shaft 74 includes a tip end 75, which abuttingly contacts the saddle member 60, and which is rotatably attached to the saddle member 60 at a central portion of the seat portion 64, via a rivet or other similar fastener 61. The shaft 74 has a plurality of male buttressed threads 76 formed on an outer surface thereof, for selective engagement with the buttressed threads 48 of the engagement/release member 46.

Capo Operation

During installation of the capo 20 on an instrument 10, the clamping bar 40 is placed extending transversely across the strings 16 of the fretboard 14, and is engaged with the free end of the yoke 22. The position of the saddle member is adjusted through operation of the adjustment member 70, which is adjusted to cause the saddle member 60 to slide with respect to the yoke 22 until the clamping bar 40 applies a desired compressive force upon the strings.

The adjustment member 70 can be pressed inwardly to slidably move the buttressed threads 76 thereof past the buttressed threads 48 of the engagement/release member 46 in order to rapidly and easily make a coarse tightening adjustment. After the coarse tightening adjustment has been completed, the adjustment member 70 can then be selectively rotated by manually turning the handle portion 72 to make a fine tightening adjustment.

Second Embodiment

A capo according to a second embodiment of the present invention will now be described, with reference to FIGS. 11A-11C and 12-13.

Referring now to FIGS. 11A-11C and 12, a capo according to a second embodiment hereof is shown generally at 120. The capo 120 according to the second embodiment of the present invention is shown separately from the instrument, although it is used in a way similar to the capo 20 according to the first embodiment. The capo 120 shares many features with the capo 20 according to the first embodiment, and is substantially similar or identical thereto, except as specifically described or shown as being different from the capo 20 herein.

Overview

Referring now to the drawings, FIGS. 11A-11C and 12 generally show a capo 120 according to the second illustrative embodiment of the present invention. The capo 120 includes a yoke 122 having an approximate U shape, as shown. The yoke 122 includes a central support member 123, as well as first and second yoke branch portions 126, 128 respectively attached to opposite sides of the central support member 123. The capo 120 also includes a pivotally movable and padded clamping bar 140, which is pivotally connected to one yoke branch portion 126 of the yoke 122.

Figure 8A:
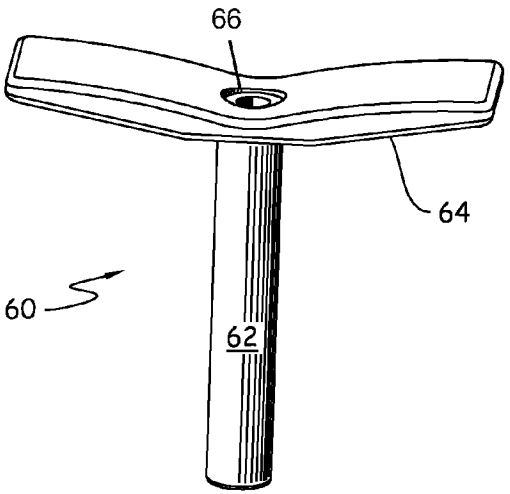
FIG. 8A is an upper perspective view of a saddle member, which is another component of the capo of FIG. 3.
Figure 8B:
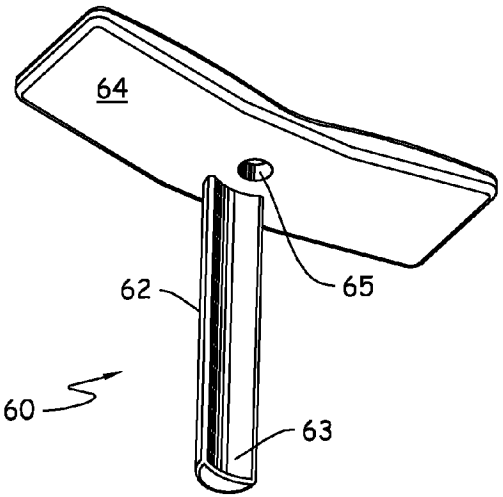
FIG. 8B is a lower perspective view of the saddle member of FIG. 8A.
Figure 8C:
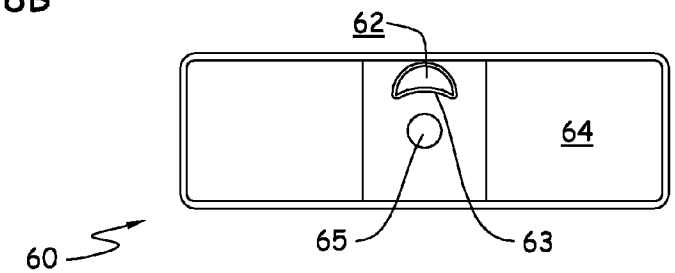
FIG. 8C is a bottom plan view of the saddle member of FIG. 8A.

The capo 120 also includes a saddle member (not shown), which slidably fits through a bore formed in the central support member of the yoke 122. The saddle member of the second embodiment is substantially identical to the saddle member 60 of the first embodiment, as previously described herein, and as shown in FIGS. 8A-8C.

The capo 120 also includes an adjustment member 170, which is rotatably attached to the saddle member in a manner so as to allow free rotation of the adjustment member 170 relative to the saddle member. The adjustment member 170 is operatively connected to the central support member 123 of the yoke 122, as will be further described herein. The adjustment member 170 may be provided with buttressed threads, or alternatively, may use conventional threading.

The capo 120 further includes a spring-loaded engagement/release member 146 (seen best in FIG. 12), disposed in a central bore of the central support member 123 so as to be pivotally movable therein. The engagement/release member 146 is pivotally movable about an axis 144 between a first, engaged position shown in solid lines in FIG. 12, and a second, disengaged position shown in phantom.

The engagement/release member 146 is provided for selectively engaging or releasing the adjustment member 170, to allow for either coarse or fine adjustment of the position of the saddle member 60 during use. Coarse adjustment is facilitated when the engagement/release member 146 is pressed upwardly to the disengaged position shown in phantom in FIG. 12, but this upward pressing of the engagement/release member may be optional, where buttressed threads are used.

The yoke 122 has a U-shape or generally semi-circular arcuate shape, and includes a central support member 123, and first and second yoke branch portions 126, 128, attached to opposite sides of the central support member. The capo 120 also includes a pivotally movable and padded clamping bar 140, which is pivotally connected to one yoke branch portion 126 of the yoke 122.

The capo 120 also includes an adjustment member 170, which is operatively connected to the central support member 123 of the yoke 122. The adjustment member 170 is also operatively connected to the saddle member 60 in a manner so as to allow free rotation of the adjustment member relative to the saddle member.

The central support member 123 has a hollow bore 125 formed centrally therethrough to accommodate the shaft portion of the saddle member 60, as well as a threaded shaft portion 174 of the adjustment member 170.

The capo 120 includes the generally U-shaped yoke 122 including the central support member 123, the movable clamping bar 140 which is pivotally attached to the yoke 122 by a pivot member 130 (which may be a rivet), and the spring-loaded engagement/release member 146 (FIG. 12) which is pivotally attached to the central support member 123 of the yoke, and which is pivotally movable between an engaged position and a release position.

Figure 13:
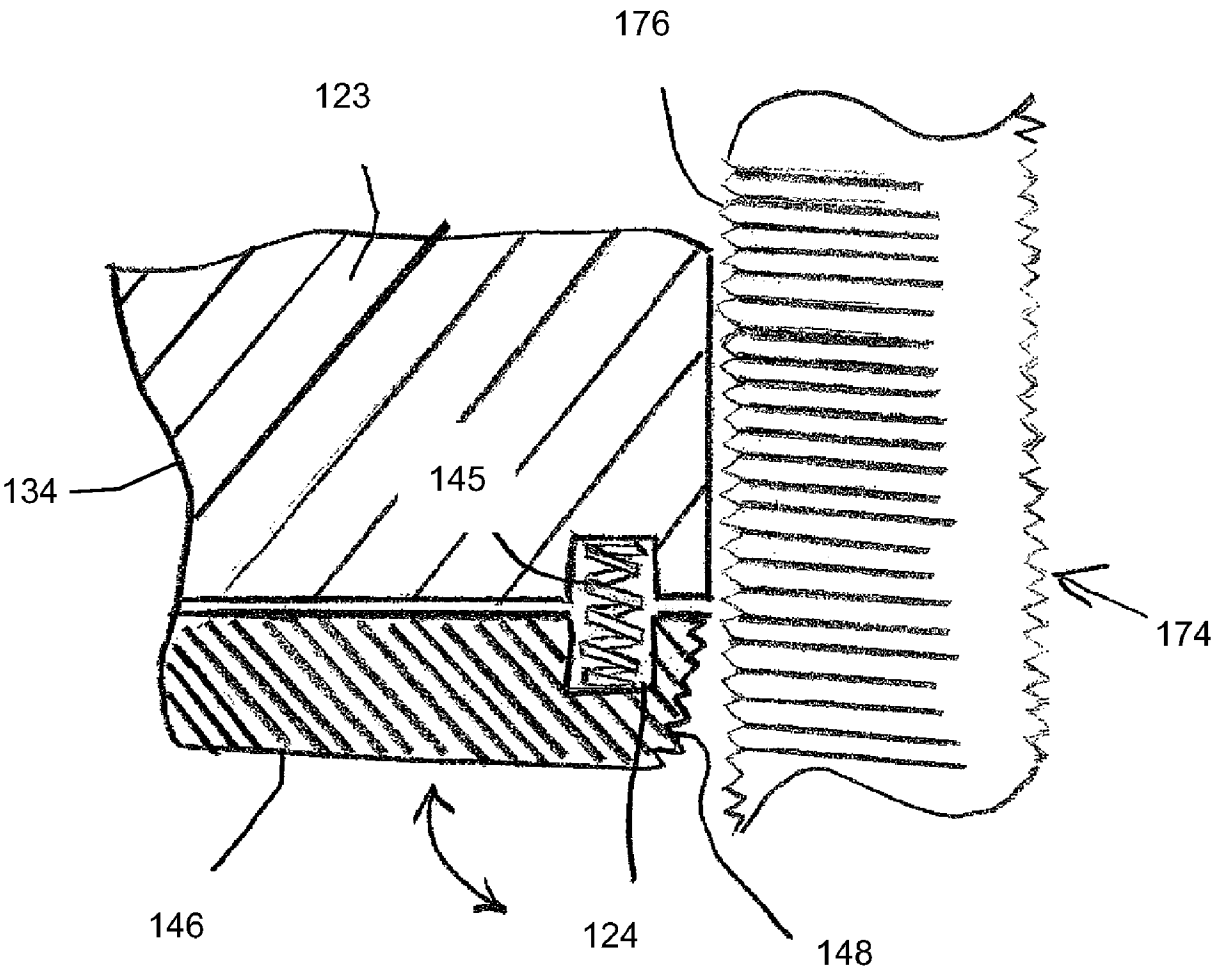
FIG. 13 is a cross-sectional detail view showing the internal structure of the engagement portion of FIG. 12.

As shown in the detail view of FIG. 13, in the depicted embodiment, the central support member 123 has a small hollow recess formed therein to receive one end of a spring 145, and the engagement/release member has a corresponding small hollow recess formed therein to receive the other end of the spring 145. The two adjacent small recesses cooperate to form a spring case 124. Other types of springs such as, for example, torsion springs may be used without departing from the scope of the invention. Those in the art will understand how to modify the central support member 123 to accommodate a torsion spring.

The central support member 123 also has first and second support arms 132, 134 extending outwardly on substantially opposite sides thereof, and each of these support arms has a respective opening 133, 135 formed therein for receiving respective lower end portions of the yoke branches 126, 128 therein.

The capo 120 also includes the substantially Y-shaped saddle member 60, similar to that shown in FIGS. 8A-8C, which slidably fits through the hollow bore 125 of the central support member from above during assembly, and an adjustment member 170 which slidably fits through the second hollow bore 27 of the central support member from below, and which is used to position the saddle member 60 in the yoke 122. The tip end of the adjustment member 170 is then rotatably joined to the saddle member with a fastener such as a rivet.

Rapid positioning of the saddle member 60 is made possible by both coarse and fine adjustment of the adjustment member 170 engaged therewith, as will be described in further detail herein.

The yoke 122 according to the second illustrative embodiment also includes the first yoke branch 126 extending outwardly on one side of the central support member 123, and the second (free) yoke branch 128 extending outwardly on the other side of the central support member. The first yoke branch 126 includes a first branch end 126*a* having a bent portion with a first opening formed therein to receive the pivot member 130, for pivotally attaching the clamping bar 140 to the yoke 122. The pivot member 130 may be a rivet.

The capo 120 according to the second illustrative embodiment also includes the clamping bar 140 having a first end 141, which is pivotally connected with the bent portion of the first yoke branch end 26*a* via the pivot member 130. The engagement of the clamping bar 140 with the yoke 122 is substantially identical to the engagement of the clamping bar 40 with the yoke 22 as previously described in connection with the first embodiment.

The capo according to the second illustrative embodiment also includes a spring 145 disposed in the spring case 124 formed between the central support member 123 and the engagement/release member 146. This spring 145 may be a coil spring, as shown, or alternatively, a different spring arrangement may be used, as may occur to those skilled in the art. The spring tends to expand and to bias the engagement/release member 146 into an engaged position, in which a threaded boss 146 thereof engages with the threads 176 provided on the shaft 174 of the adjustment member 170, as shown by the arrow in FIG. 13.

When the engagement/release member 146 is "pinched" upwardly against a support arm 134 of the central support member 123, this movement compresses the spring 145 between the engagement/release member and the central support member, and moves the threads 148 of the engagement/release member 146 out of alignment with the threads 176 of the adjustment member 170.

When the engagement/release member 146 is in the release position (as shown in FIG. 13), a quick, sliding coarse adjustment of the adjustment member 170 and the attached saddle member 60 can be easily made, relative to the yoke 122.

Conversely, when the engagement/release member 146 is in the engaged position, a fine rotating threaded adjustment of the adjustment member 170 and the attached saddle member 60 can be made relative to the yoke 122. This is accomplished by rotating a thumbscrew or handle 172 (FIG. 12) of the adjustment member 170, to spin the threads 176 thereof in the threads 148 of the engagement/release member 146.

Method of Using the Capo

The present invention also relates to a method of installing a capo 20 on a stringed instrument 10.

An illustrative example of a method of using the capo 20 hereof involves a first step of pivotally moving the clamping bar 40 out of the way of an opening 21 (FIG. 3) formed in a yoke 22 of the capo.

The method then includes a step of placing the capo 20 on a neck 12 of the stringed instrument 10, such that the neck is received into the opening 21 of the yoke 22.

The method then includes a step of pivotally moving the clamping bar 40 into engagement with the yoke 22 by aligning a notch 43 formed in a free end portion 42 of the bar with a corresponding notch 29 formed in a branch portion 28 of the yoke, and engaging the bar with the yoke.

The method then includes an optional step of moving an engagement/release member 46 housed in a central support member 23 of the yoke 22, to overcome the force of a spring 45 and to move female threads 48 formed on of the engagement/release member away from male threads 76 formed around a threaded shaft 74 of the adjustment member 70, which is inserted through the hollow bore 47 of the engagement/release member. This step may be omitted, if desired.

The method then includes a step of making a coarse adjustment of the capo in relation to the instrument. This coarse adjustment is effected by pressing the adjustment member 70 inwardly towards the instrument neck 12, thereby causing the male threads 76 on the outside of the threaded shaft 74 of the adjustment member to slide past the female buttressed threads 48 formed inside of the spring-loaded release member 46, until a saddle member 60 of the capo contacts a rear portion of the instrument neck.

The method then includes a final step of making a fine adjustment by rotating a handle 72 of the adjustment member 70, to spin the threads 76 thereof in the corresponding threads 48 of the engagement/release member.

While the reference numbers given above are those corresponding to the first embodiment, a similar method is used in installing and tightening the capo 120 according to the second embodiment on a stringed instrument 10.

Third Embodiment

A third embodiment of a capo according to the present invention will now be described, with reference to FIGS. 14A-14D.

Referring now to FIGS. 14A-14D, a capo according to a third embodiment hereof is shown generally at 220. The capo 220 according to the third embodiment of the present invention is shown separately from the instrument, although it is used in a similar way to the capo 20 according to the first embodiment. The capo 220 shares many features with the capo 20 according to the first embodiment, and is substantially similar or identical thereto, except as specifically described or shown as being different from the capo 20 herein.

Overview

Figure 14A:
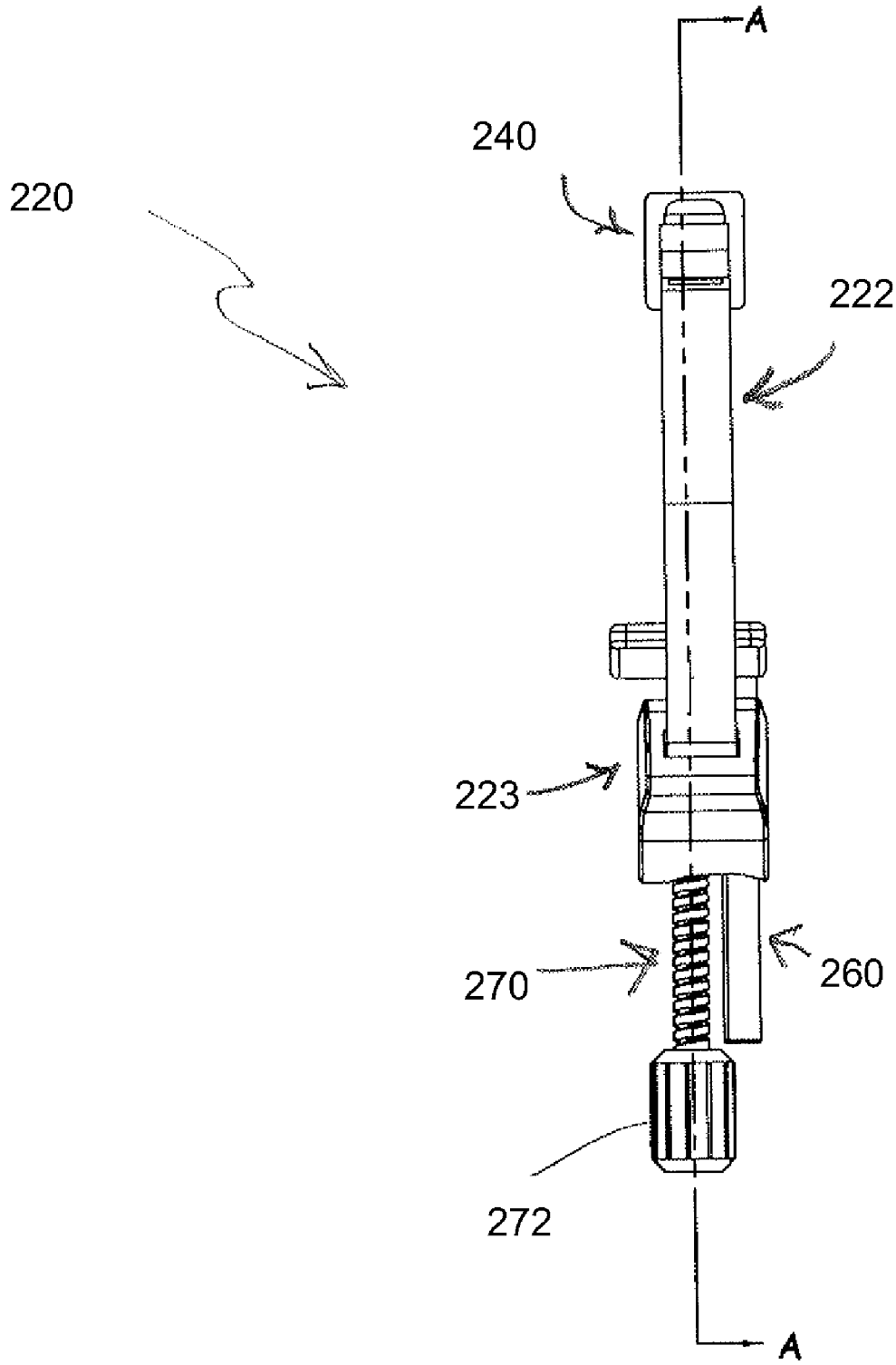
FIG. 14A is a side plan view of a capo according to a third illustrative embodiment of the present invention.
Figure 14B:
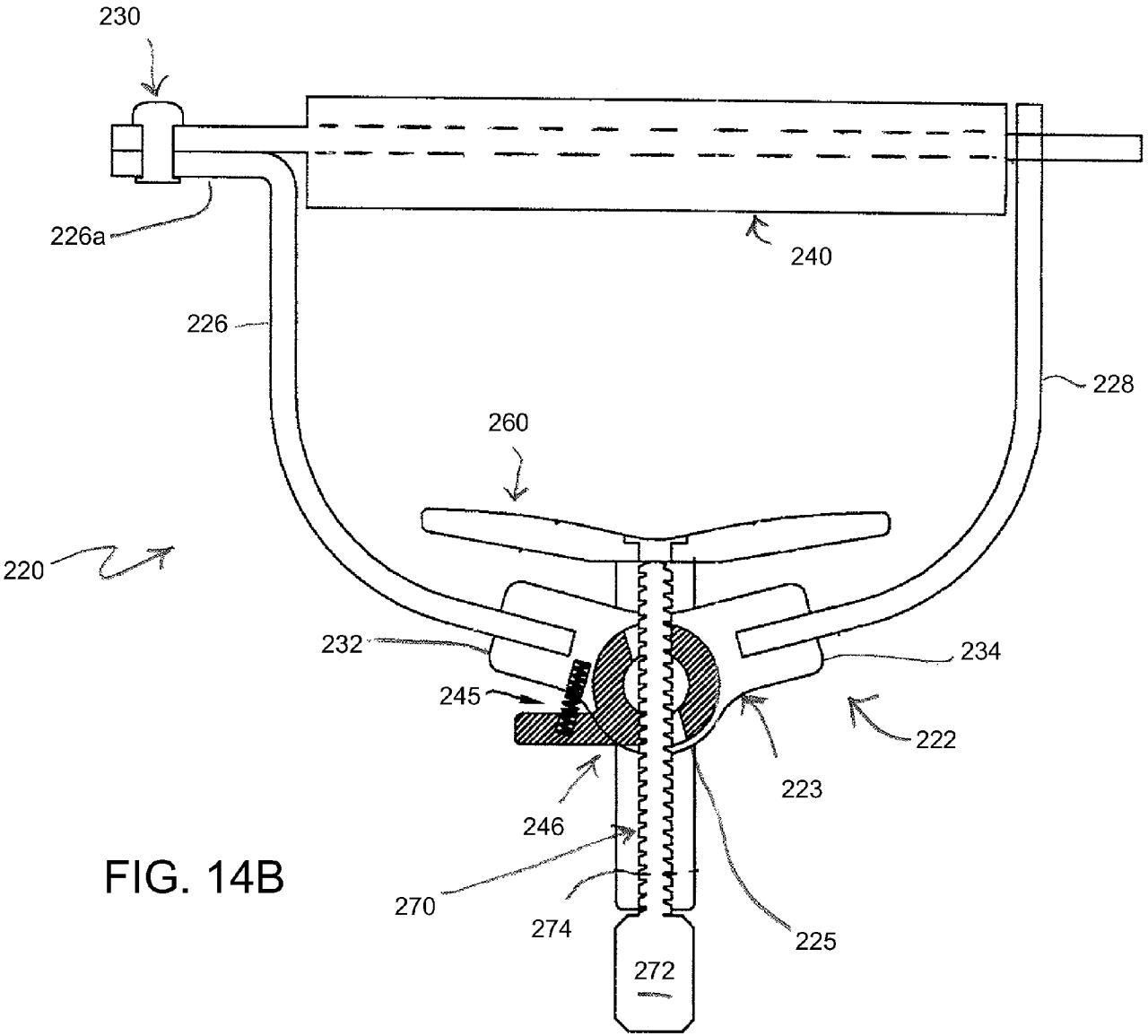
FIG. 14B is a front plan view, partially cut away, of the capo of FIG. 14A, showing an engagement portion thereof in an engaged position.
Figure 14C:
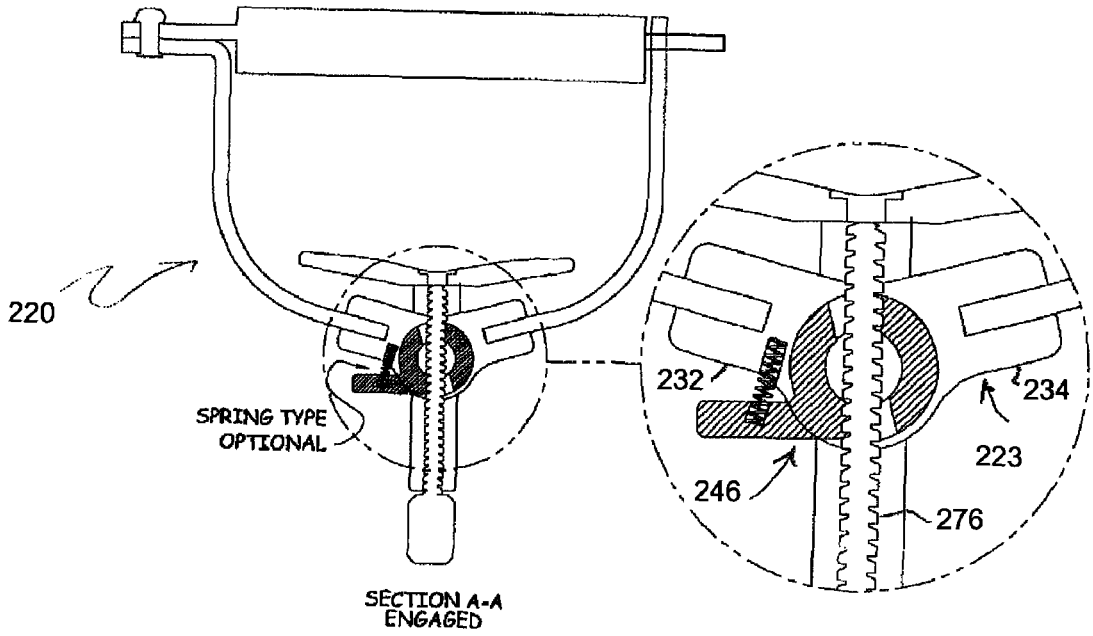
FIG. 14C is a front plan view similar to FIG. 14B and including an enlarged detail view of a central portion of the capo.

Referring now to the drawings, FIGS. 14A-14C generally show a capo 220 according to the second illustrative embodiment of the present invention. The capo 220 includes a yoke 222 having an approximate U-shape, as shown. The yoke 222 includes a central support member 223, as well as first and second yoke branch portions 226, 228 respectively attached to opposite sides of the central support member 223. The capo 220 also includes a pivotally movable and padded clamping bar 240, which is pivotally connected to one yoke branch portion 228 of the yoke 222.

The capo 220 also includes a saddle member 260, which slidably fits through a bore formed in the central support member of the yoke 222, and an adjustment member 270, which is rotatably attached to the saddle member in a manner so as to allow free rotation of the adjustment member relative to the saddle member. The adjustment member 270 is operatively connected to the central support member 223 of the yoke 222, as will be further described herein.

The capo 220 further includes a spring-loaded engagement/release member 246 disposed in a central bore of the central support member 223 and pivotally movable therein. The engagement/release member 246 is provided for selectively engaging or releasing the adjustment member 270, to selectively allow either coarse or fine adjustment of the position of the saddle member 260 during use.

The saddle member 260 is substantially identical to the saddle member 60 according to the first embodiment as shown in FIGS. 8A-8C. The capo adjustment member 270 is operatively connected to the central support member 223 of the yoke 222.

The central support member 223 has a hollow bore 225 formed centrally therethrough to accommodate the shaft portion of the saddle member 60, as well as a threaded shaft 274 of the adjustment member 270. In this third embodiment, as shown in FIG. 14B, the threaded shaft 274 of the adjustment member 270 has buttressed threads formed thereon.

The spring-loaded engagement/release member 246 is pivotally movable between an engaged position and a release position, as shown.

As shown in FIG. 14B, the central support member 223 has a hollow recess formed therein to receive one end of a spring 245, and the engagement/release member has a corresponding hollow recess formed therein to receive the other end of the spring. The two adjacent recesses cooperate to form a spring case. The central support member 223 also has first and second support arms 232, 234 extending outwardly on substantially opposite sides thereof, and each of these support arms has a respective opening formed therein for receiving respective lower end portions of the yoke branches 226, 228 therein.

The capo 120 also includes the substantially Y-shaped saddle member 260, which slidably fits through the hollow bore 225 of the central support member from above during assembly, and an adjustment member 270 which slidably fits through the hollow bore of the central support member from below, and which is used to position the saddle member 260 in the yoke 222. The tip end of the adjustment member 270 is then rotatably joined to the saddle member with a fastener, which may be a rivet. The saddle member 260 is substantially identical to the saddle member 60 of the first embodiment as previously described.

Rapid positioning of the saddle member 260 is made possible by both coarse and fine adjustment of the adjustment member 270 engaged therewith, as will be described in further detail herein.

The yoke 222 according to the third illustrative embodiment also includes the first yoke branch 226 extending outwardly on one side of the central support member 223, and the second (free) yoke branch 228 extending outwardly on the other side of the central support member. The first yoke branch 226 includes a first yoke branch end 226*a* having a bent portion with an opening formed therein to receive the pivot member 230. The pivot member 230 may be a rivet.

The capo 220 according to the third illustrative embodiment also includes the clamping bar 240 having a first end 241, which is pivotally connected with the bent portion of the first yoke branch end 226*a* via the pivot member 230. The engagement of the clamping bar 240 with the yoke 222 is substantially identical to the engagement of the clamping bar 40 with the yoke 22 as previously described in connection with the first embodiment.

The capo according to the third embodiment also includes a spring 245 disposed in the spring case 224 formed between the central support member 223 and the engagement/release member 246. This spring 245 may be a coil spring, as shown, or alternatively, a different spring arrangement may be used, such as a torsion spring or other spring as may occur to those skilled in the art. The spring biases the engagement/release member 146 into an engaged position, in which opposed threaded boss portions thereof engage with the threads 276 of the adjustment member 270, as shown in FIG. 14C.

When the engagement/release member 246 is "pinched" against a support arm 232 of the central support member 223, this movement compresses the spring 245 between the engagement/release member and the central support member, and moves the threaded bosses of the engagement/release member 246 out of alignment with the threads 276 of the adjustment member 270.

Figure 14D:
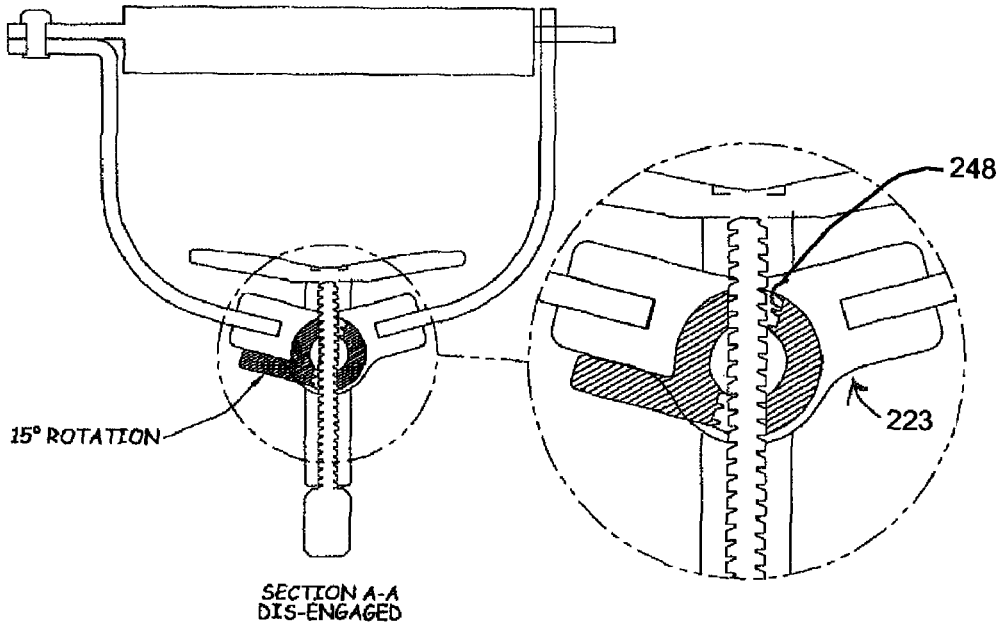
FIG. 14D is a front plan view of the capo of FIG. 14A-B, similar to FIG. 14C, but showing an engagement portion thereof in a disengaged position.

When the engagement/release member 246 is in the release position (as shown in FIG. 14D), a quick, sliding coarse adjustment of the adjustment member 270 and the attached saddle member 260 can be made, relative to the yoke 222.

When the engagement/release member 246 is in the engaged position, a fine rotating threaded adjustment of the adjustment member 270 and the attached saddle member 260 can be made relative to the yoke 222. This is accomplished by rotating a handle 272 of the adjustment member 270, to spin the threads 276 thereof in the threads 248 of the engagement/release member 246.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

Having, thus, described the invention, what is claimed is:

1. A capo for use with a stringed musical instrument having a neck including a fretboard and a plurality of strings extending parallel to one another above said fretboard, said capo comprising yoke assembly and a slide assembly which is adjustably movable relative to said yoke assembly;

said yoke assembly comprising a substantially U-shaped yoke, a clamping bar which is pivotally attached to said yoke, and an engagement/release member which is operatively attached to said yoke, and said slide assembly comprising a saddle member and an adjustment member which is operatively attached to said saddle member;

said engagement/release member having an engaging section for engaging a shaft of the adjustment member;

said yoke comprising a central support member, a first yoke branch extending outwardly on one side of said support member, and a second yoke branch extending outwardly on the other side of said support member; said first yoke branch terminating at a first yoke branch end having a bent portion, said second yoke branch terminating at a free branch end having a notch formed therein;

said clamping bar having a first end and a second end, said first end of the clamping bar being pivotally connected with said first yoke branch end, and said second end of the clamping bar being operatively engagable with the notch of the second yoke branch for temporarily and releasably locking said clamping bar onto said second yoke branch end;

wherein said saddle member is substantially Y-shaped and comprises a central stem and a seat portion integrally attached to an end of said stem for placement contacting a portion of said neck opposite said fretboard;

wherein the slide assembly can be slidably moved relative to the yoke assembly in a coarse tightening adjustment, and wherein a handle portion of the adjustment member can be selectively rotated to make a fine tightening adjustment of the slide assembly.

2. A capo for use with a stringed musical instrument having a neck including a fretboard and a plurality of strings extending parallel to one another above said fretboard, said capo comprising yoke assembly and a slide assembly which is adjustably movable relative to said yoke assembly;

said yoke assembly comprising a substantially U-shaped yoke, a clamping bar which is pivotally attached to said yoke, and a spring-loaded engagement/release member which is operatively attached to said yoke, and said slide assembly comprising a saddle member and an adjustment member which is rotatably attached to said saddle member;

said engagement/release member having a thread-engaging section for engaging a threaded shaft of the adjustment member, and said engagement/release member having an actuation surface provided thereon configured for contact by a user to move said engagement/release member in a direction against the force of a spring;

said yoke comprising a central support member with a hollow bore formed therein defining a first axis, a first yoke branch extending outwardly on one side of said support member and a second yoke branch extending outwardly on the other side of said support member; said first yoke branch terminating at a first yoke branch end having a bent portion, said second yoke branch terminating at a free branch end having a notch formed therein;

said clamping bar having a first end and a second end, said first end of the clamping bar being pivotally connected with said first yoke branch end, and said second end of the clamping bar being operatively engagable with the notch of the second yoke branch for temporarily and releasably locking said clamping bar onto said second yoke branch end;

wherein said saddle member is substantially Y-shaped and comprises a central stem and a seat portion integrally attached to an end of said stem for placement contacting a portion of said neck opposite said fretboard;

wherein the adjustment member comprises a graspable handle portion and a shaft portion which is disposed proximate the stem of said saddle member, said shaft portion having male threads formed on an outer surface thereof for selective engagement by the thread-engaging section of the engagement/release member;

and wherein, when the actuation surface of the engagement/release member is pressed to move the thread-engaging section of the engagement member out of engagement with the adjustment member, the slide assembly can be slidably moved relative to the yoke assembly in a coarse tightening adjustment, and when the actuation surface of the adjustment member is released, the handle portion of the adjustment member can then be selectively rotated to make a fine tightening adjustment of the slide assembly.

3. The capo of claim 1, wherein a portion of the engagement/release member has buttressed threads formed thereon, and wherein the shaft of the adjustment member also has buttressed threads formed thereon.

4. The capo of claim 2, wherein the thread-engaging section of the engagement/release member has buttressed threads formed thereon, and wherein the shaft of the adjustment member also has buttressed threads formed thereon.

5. A capo for use with a musical instrument having a neck including a fretboard and a plurality of strings extending parallel to one another above said fretboard, said capo comprising:

a substantially U-shaped yoke, said yoke comprising:

a central support member with a first hollow bore formed therein defining a first axis and having a back wall at the innermost portion of said first hollow bore, said support member also having a second hollow bore formed therethrough defining a second axis which is substantially perpendicular to said first axis, said second hollow bore intersecting said first hollow bore;

a first yoke branch extending outwardly on one side of said support member and a second yoke branch extending outwardly on the other side of said support member, said first yoke branch terminating at a first yoke branch end having a bent portion with a first opening formed therein, said second yoke branch terminating at a second yoke branch end;

a clamping bar having a first end and a second end, said first end of said clamping bar being pivotally connected with said first yoke branch end, and said second end of said clamping bar being operatively engagable with the opening of the second yoke branch for temporarily and releasably locking said clamping bar onto said second yoke branch end;

a substantially Y-shaped saddle member, said saddle member comprising a central stem with a substantially crescent-shaped cross-section defining a hollow channel therein, and a seat portion integrally attached to an end of said stem for placement contacting a portion of said neck opposite said fretboard; said seat portion having a recessed cavity formed therein adjacent a juncture of said stem portion therewith;

a spring disposed in said first hollow bore of said yoke adjacent the back wall thereof;

an engagement/release member configured to fit slidably in said first hollow bore of said yoke, said engagement/release member having a hollow opening formed therethrough having a substantially oval cross-sectional shape with buttressed female threads formed therein on one side of said hollow opening, wherein said stem of said saddle member fits through the hollow opening of the engagement/release member, said opening in said engagement/release member being alignable with the second hollow bore of said yoke, said engagement/release member having an inner end with a spring-contacting surface for contacting said spring, and an outer end opposite said inner end and extending outwardly from said yoke, said outer end comprising an engaging surface provided for being contacted by a user to press said engagement/release member inwardly against the spring;

an adjustment member comprising a graspable handle portion and a shaft portion which fits into the concave groove of said saddle member, said shaft portion having a tip end which fits into the recessed cavity of the saddle member and also having male threads formed on an outer surface thereof for selective engagement with the threads of the engagement/release member;

whereby the adjustment member can be pressed inwardly to slidably move the buttressed threads thereof past the buttressed threads of the engagement/release member in order to make a coarse tightening adjustment, and the handle portion of the adjustment member can then be selectively rotated to make a fine tightening adjustment.

6. A capo for use with a stringed musical instrument having a neck including a fretboard and a plurality of strings extending parallel to one another above said fretboard, said capo comprising:

a substantially U-shaped yoke, said yoke comprising:

a central support member with a first hollow bore formed therein defining a first axis and having a back wall at the innermost portion of said first hollow bore, said support member also having a second hollow bore formed therethrough defining a second axis which is substantially perpendicular to said first axis, said second hollow bore intersecting said first hollow bore;

a first yoke branch extending outwardly on one side of said support member and a second yoke branch extending outwardly on the other side of said support member, said first yoke branch terminating at a first yoke branch end having a bent portion, said second yoke branch terminating at a free branch end having a notch formed therein;

a clamping bar having a first end and a second end, said first end of said clamping bar being pivotally connected with said first yoke branch end, and said second end of said clamping bar being operatively engagable with the notch of the second yoke branch for temporarily and releasably locking said clamping bar onto said second yoke branch end;

a substantially Y-shaped saddle member comprising a central stem and a seat portion integrally attached to an end of said stem for placement contacting a portion of said neck opposite said fretboard;

a spring disposed in said first hollow bore of said yoke adjacent the back wall thereof;

an engagement/release member configured to fit slidably in said first hollow bore of said yoke, said engagement/release member having a hollow opening formed therethrough having a substantially oval cross-sectional shape with buttressed female threads formed therein on at least one side of said hollow opening, wherein said stem of said saddle member fits through the hollow opening of the engagement/release member, said opening in said engagement/release member being alignable with the second hollow bore of said yoke, said engagement/release member having an inner end with a spring-contacting surface for contacting said spring, and an outer end opposite said inner end and extending outwardly from said support member of said yoke, said outer end comprising an engaging surface provided for being contacted by a user to press said engagement/release member inwardly against the spring;

an adjustment member comprising a graspable handle portion and a shaft portion rests against said saddle member, said shaft portion having male buttressed threads formed on an outer surface thereof for selective engagement with the buttressed threads of the engagement/release member;

whereby the adjustment member can be pressed inwardly to slidably move the buttressed threads thereof past the buttressed threads of the engagement/release member in order to make a coarse tightening adjustment, and the handle portion of the adjustment member can then be selectively rotated to make a fine tightening adjustment.

7. A method of installing a capo on a stringed instrument, comprising the steps of:

pivotally moving a clamping bar out of the way of an opening formed in a yoke on the capo;

placing the capo on a neck of said stringed instrument, such that the neck is received into the opening of said yoke;

pivotally moving the clamping bar back into engagement with the yoke by aligning a notch formed in a free end portion of the clamping bar with a corresponding notch formed in a branch portion of the yoke, and engaging said clamping bar with said yoke;

optionally, pressing on an engagement/release member housed in a central support member of the yoke, to overcome the force of a spring and to move threads formed inside of the engagement/release member away from other threads formed around a threaded shaft of an adjustment member which is inserted through a hollow bore of the engagement/release member;

making a coarse adjustment by pressing an adjustment member inwardly towards the guitar neck, to slide the threaded shaft of the adjustment member to slide past buttressed threads formed inside of the spring-loaded release member, thereby moving a saddle member of the capo towards the neck of said stringed instrument; and making a fine adjustment by rotating a handle of the adjustment member to spin the threads thereof in the threads of the engagement/release member, thereby tightening the saddle member against the neck of the instrument.

* * * * *